United States Patent [19]

Mizota et al.

[11] Patent Number: 4,649,985

[45] Date of Patent: Mar. 17, 1987

[54] METHOD OF ELECTROMAGNETIC STIRRING A MOLTEN STEEL IN A MOLD FOR A CONTINUOUS CASTING

[75] Inventors: Hisakazu Mizota; Shinji Kojima; Masanori Kodama; Yasuharu Miyazaki, all of Kurashiki, Japan

[73] Assignee: Kawasaki Steel Corporation, Kobe, Japan

[21] Appl. No.: 686,480

[22] PCT Filed: Aug. 9, 1984

[86] PCT No.: PCT/JP84/00398

§ 371 Date: Dec. 12, 1984

§ 102(e) Date: Dec. 12, 1984

[87] PCT Pub. No.: WO85/00769

PCT Pub. Date: Feb. 28, 1985

[30] Foreign Application Priority Data

Aug. 11, 1983 [JP] Japan ..... 58-145765

[51] Int. Cl.[4] ..... B22D 27/02

[52] U.S. Cl. ..... 164/468; 164/504

[58] Field of Search ..... 164/468, 504, 147.1, 164/466, 502, 499

[56] References Cited

FOREIGN PATENT DOCUMENTS 13441 7/1980 European Pat. Off. ..... 164/504

55-40004 3/1980 Japan ..... 164/468

*Primary Examiner*—Kuang Y. Lin

*Attorney, Agent, or Firm*—Balogh, Osann, Kramer, Dvorak, Genova & Traub

[57] ABSTRACT

Electromagnetically stirring a molten metal in a continuously casting mold, wherein a plurality of linear motor type stirrer units each having a square shape each side of which is smaller than the height dimension of the mold are arranged in parallel along the long sides of the mold in such a manner that they are adapted to change the attached posture by 90°, so as changing the direction of a stirring flow of the molten steel into a given direction. As a result the surface defect is removed and the quality of the solidification structure is improved, and the application range of the kinds of the steels to be cast can be enlarged.

6 Claims, 17 Drawing Figures

METHOD OF ELECTROMAGNETIC STIRRING A MOLTEN STEEL IN A MOLD FOR A CONTINUOUS CASTING

TECHNICAL FIELD

The present invention relates to a method of electromagnetically stirring a molten steel in a mold for continuous casting. More particularly, the invention relates to a molten steel-continuous casting which readily realizes the optimum stirring pattern of the molten steel in the mold for the continuous casting so as to contribute mainly to the improvement of the quality of continuous cast slabs over various kinds of steels and for the respective kinds of the steels.

BACKGROUND TECHNIQUE

The electromagnetically stirring of the molten steel in the mold for the continuous casting (hereinafter referred to briefly as "mold") is generally aimed at the improvement on the surface defects of the surface portion of the continuously cast slab, particularly improvement in the quality of the solidification structure, and occasionally is aimed at enlargement of the kinds of steels to be cast (such as slightly deoxidized steel), and its application has recently been widely tried.

With respect to the direction in which the molten steel in the mold is electromagnetically stirred, the stirring is broadly classified into horizontal stirring and vertical stirring.

The horizontal stirring forcedly causes the molten steel in the mold to flow in a horizontal plane, and the horizontal circulation flow as shown in solid lines in FIGS. 1*a* and 1*b* or one way parallel flow as also shown by solid lines in FIG. 1*c* is produced in the bath surface of the molten steel in the mold.

On the other hand, the vertical stirring forcedly causes the flow of the molten steel in the mold along the height direction of the mold (that is, as shown by arrows of FIGS. 2*a* and 2*b*) as if the flow would be to a rimming action in the ingot making process of a rimmed steel (hereinafter referred to as rimming flow) or occasionally in a direction opposite thereto.

The direction in which the molten steel flows is generally shown by the arrow 1 in each of the figures, in which a reference numeral 2 is a mold, a reference numeral 3 a molten steel in the mold, and a reference numeral 4 a linear motor type stirrer. The direction of the electromagnetically stirring thrust is shown by white arrows 5, and a reference numeral 6 is an immersion nozzle.

The directional selection of either one of the horizontal stirring and the vertical stirring is made depending upon the stirring purpose and power to be applied.

The ordinary profile of the continuously cast piece such as the slabs is 200–300 mm in thickness and 1,000–2,500 mm in width. The height of the mold 2 serving for the continuous casting is ordinarily 700–900 mm in height, and therefore the width of the mold 2 reaches approximately 2–3 times as large as the height thereof.

Therefore, from the standpoint of the stirring efficiency, the horizontal stirring of FIG. 1 in which the distance for acceleration of the stirrer 4 can be made larger is more advantageous as compared with the vertical stirring of FIG. 2, and the stirring speed can be made larger in the former case. However, since stagnation is likely to be produced at both the ends in the width direction of the mold 2, that is, in the vicinity of the corners of the short sides, there is the liklihood that bubbles and non-metallic inclusions are accumulated near the corners.

To the contrary, the vertical stirring is inferior in terms of the stirring efficiency as mentioned above, but is more advantageous in that the rimming flow directly serves to float the bubbles and the inclusions. The concentrated stagnation is relatively hard to be formed, and it can be said that since the vicinity of the meniscus becomes the termination point of the acceleration, the vertical stirring is suitable for mainly stirring the vicinity of the meniscus.

From the foregoing, the general adoption standard for the stirring of the molten steel in the mold can be summarized as follows:

When the stirring flow speed is intended to be large and particularly the effect of cleaning off the bubbles and the inclusions at the solidification interface is intended, the horizontal stirring, particularly in a swirling fashion, is well suited, while the vertical stirring is suitable for the purpose of improving the quality of the surface portion through stirring the vicinity of the meniscus and controlling the flowing in the mold.

As mentioned above, the stirring directions both have their own merits and demerits, and when in application, it is necessary to select such a stirring system as is suited for the kind and the composition of a steel and the casting conditions in each operation.

Therefore, since the continuously casting apparatus to which is applied the conventional electromagnetic stirring of the molten steel in the mold is restricted to a single stirring system despite it treats various kinds of steels, the advantage of improving the quality can not be fully exhibited thereby.

Further, even through it is preferably that both horizontal and vertical stirring systems are selectively used depending upon the kinds of the steels and the casting conditions, as shown in FIGS. 1 and 2, the conventional system stirrers have the width extended over substantially the whole width of the mold 2, so that the dimensions of the stirrer in the width direction and the height direction largely differ from each other and the installation direction of the stirrer can not be changed. Further, even if the flow can be oppositely switched in the horizontal direction or in the vertical direction by electrical operation, the directional change by 90° from the horizontal direction to the vertical direction or from the vertical direction to the horizontal direction can not be made. Thus, the conventional stirring is fixed to either the horizontal direction or vertical direction.

DISCLOSURE OF THE INVENTION

The present invention aims to eliminate the above-mentioned drawbacks, and it is an object of the invention to provide a method which enables the stirring both in the horizontal direction and in the vertical direction and by which an appropriate stirring flow can be selected to comply with various kinds of steels and casting conditions.

According to the present invention, in a method of electromagnetically stirring the molten steel in a mold by using linear motor type stirrers installed along long sides of the mold for continuous casting, a plurality of stirrers each being in a square or approximately square shape having the dimension of the mold in the height direction are arranged in parallel along the long sides of the mold, and the direction of the electromagnetically stirring thrust is selectively changed between the horizontal direction and the vertically direction or between the normal and reverse directions thereof, depending upon the intended or predetermined steel kind and casting conditions.

According to the invention, the stirring pattern of the molten metal in the mold can easily be optimized by the above-mentioned construction to comply with the kind of the steel and the casting conditions, so that the stable operation of the continuous casting apparatus and the enlargement of the use, such as the application of the weak deoxidized steel to the continuous casting, can be advantageously realized in addition to the improvement of the quality of the cast slab.

BEST MODE FOR CARRYING OUT THE INVENTION

Figure 1A:
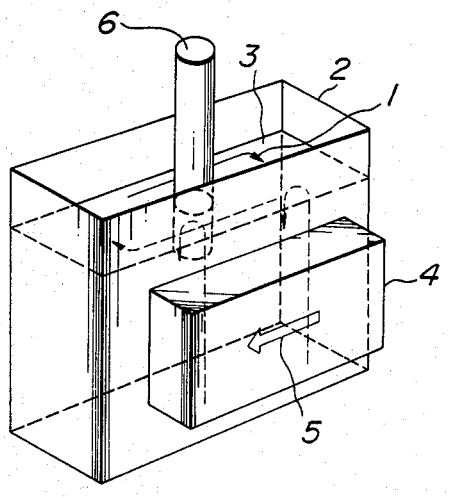
FIG. 1*a* and 1*b* are a view of an electromagnetically stirring behavior which produces horizontally swirling flow and a plane skeleton view thereof.
Figure 1B:
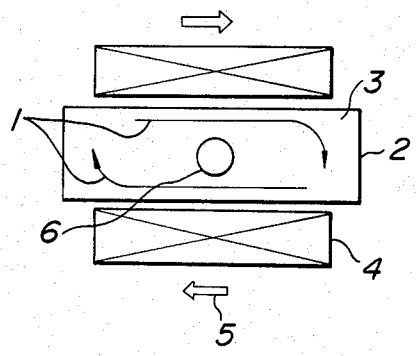
Figure 1C:
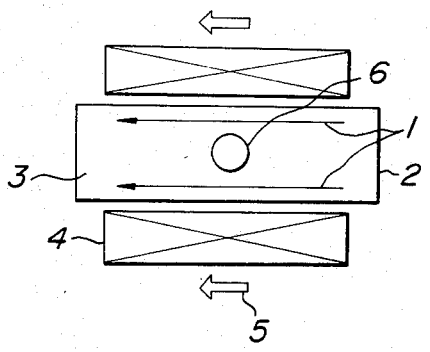
FIG. 1*c* is a skeleton view of a plane of the mold illustrating the state of a parallel flow.
Figure 2A:
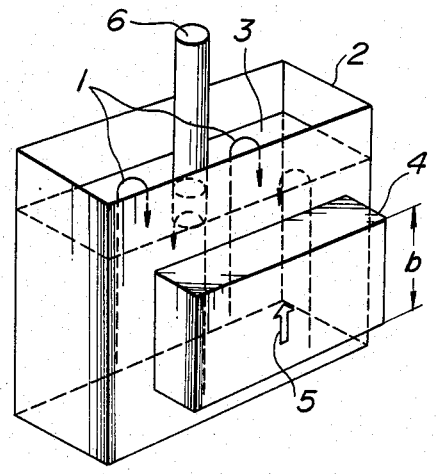
FIGS. 2*a* and 2*b* are a view illustrating a stirring behavior in a rimming flow and a skeleton view of the mold at the sectionally middle portion.
Figure 2B:
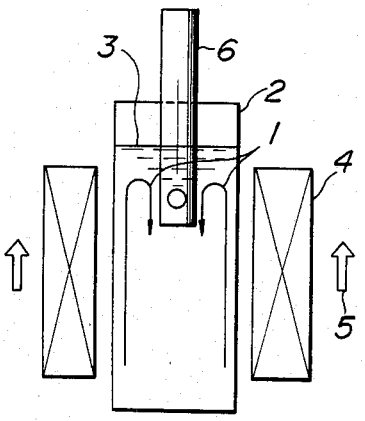
Figure 3A:
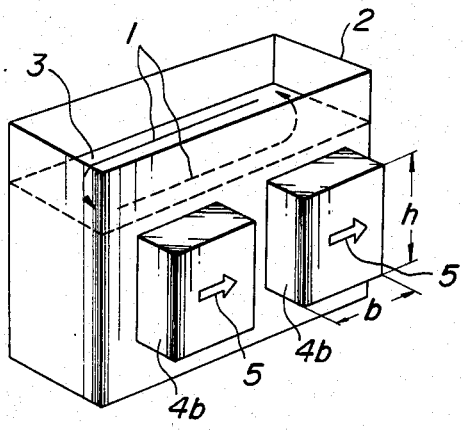
FIGS. 3*a* and 3*b* and FIGS. 4*a* and 4*b* are schematic views illustrating an example in which the stirring behavior is changed by divided stirrer units according to the present invention, and plane skeleton views of the molds.
Figure 3B:
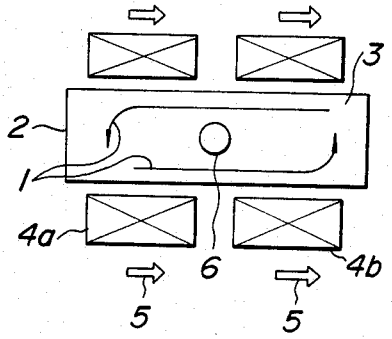
Figure 4A:
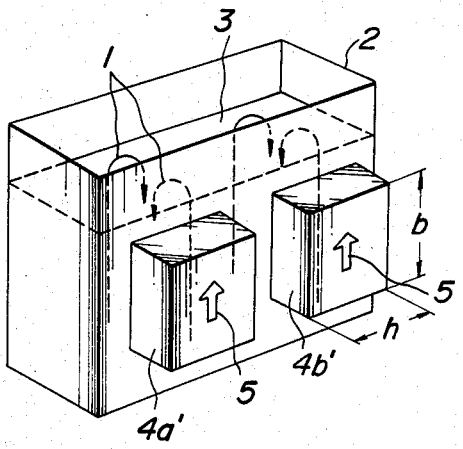
Figure 4B:
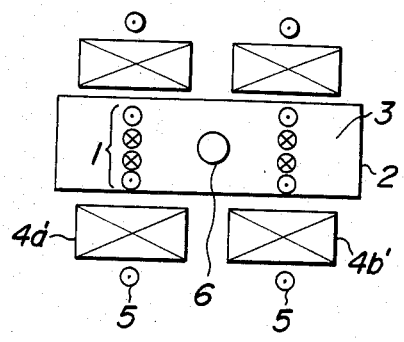

In FIGS. 3 and 4 is shown an embodiment in which a stirrer is divided into two units in a width direction of a mold such that the divided stirrer units may be attached to the mold in either vertical or lateral direction, according to the present invention. Explanation will now be made as to how to selectively use a horizontal circulating stirring and a rimming flow stirring.

That is, in this embodiment, by setting the width b of each divided stirrer unit within the limit of the installation height h (see FIG. 3*a*) in the height direction of the mold, it is possible that the direction of the electromagnetically stirring thrust of both the stirrer units 4*a* and 4*b*(that is, white arrows 5), are changed from the lateral direction in FIG. 3 to the upward direction shown in FIG. 4 through changing the attachment position of the stirrer units by 90°. The stirrer units both as oriented in the upward direction are shown by 4*a*' and 4*b*'.

Figure 5A:
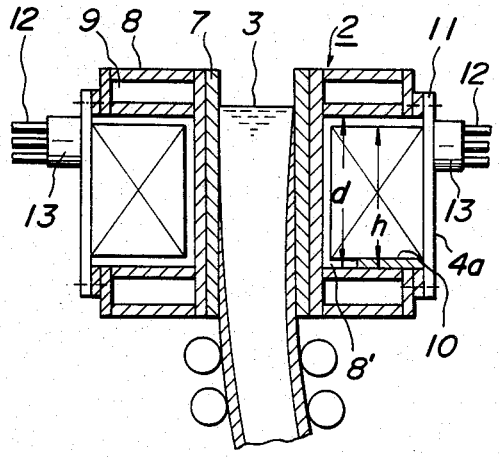
FIGS. 5*a* and 5*b* are a sectional view transversing the long sides of the mold and a front view of the long side.
Figure 5B:
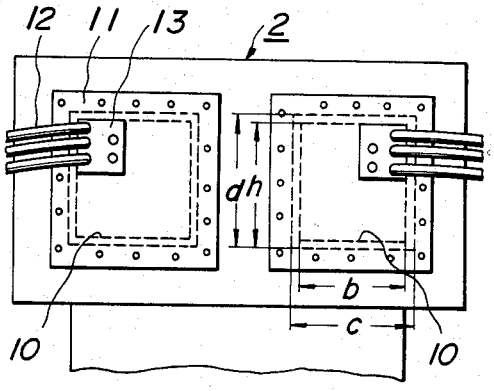

Specific examples of the mold 2 which are suitable for changing the direction of the electromagnetically stirring thrust as mentioned above are shown in FIGS. 5*a* and 5*b* and FIG. 6. In the figures, a reference numeral 7 is a water-cooled copper plate, a reference numeral 8 a mold frame, and a reference numeral 9 a cooling box.

In general, the above stirrer is required to be positioned within the cooling box of the mold frame and as near as possible to the water-cooled copper plate so that magnetic fluxes may deeply penetrate into the molten steel in the mold, the leaked magnetic fluxes are reduced, and the electromagnetic force is prevented from weakening.

In this embodiment, the mold frame 8 equipped with a back-up plate for supporting the water-cooled copper plate 7 on the side of the long side of the mold (from the back surface thereof) has a housing depression 8'shown with respect to the stirrer unit 4*a*. In the embodiment of FIG. 5, the depression is made square such that the width c and the height d thereof are slightly larger than the width b and the height h of the divided stirrer units 4*a* and 4*b* (b≅h in the illustrated embodiment). A base plate 10 is placed on the bottom of the housing depression to appropriately adjust the installation position, and a flange 11 of the stirrer unit 4*a* is fixed to the outer surface of the mold frame 8 by bolts. In the figure, a reference numeral 12 is a power supply cable and a reference numeral 13 is a terminal box for supplying the power.

Figure 6:
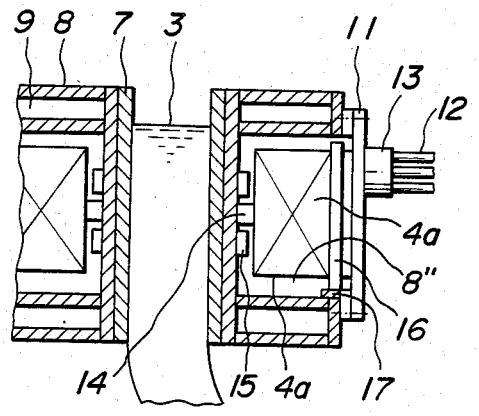
FIG. 6 is a sectional view transversing long sides of a mold in another embodiment.

In the embodiment illustrated in FIG. 6, a housing depression 8" is designed as a round hole having an inner diameter slightly larger than the diagonal distance of the divided stirrer unit 4*a*, and preferably a bearing 15 for supporting an axle 14 provided on the inner side of the divided stirrer unit 4*a* is formed on the middle sequestered portion of the housing depression 8". A receiving seat 17 is provided at the lower portion of the housing depresssion 8" for guiding the sliding of a supporting jaw ring 16 provided adjacent to the flange 11 of the divided stirrer unit 4*a*, whereby the divided stirrer unit 4*a* is adapted to change its orientation under releasing of the bolt-tightening of the divided stirrer unit 4*a*.

Although the explanation has been made on the above embodiments in which the divided stirrer units 4*a* and 4*b* are binarily divided ones, it is obvious that the stirrer can be divided into more than two units and arranged in parallel within the limit of the width of the mold.

FIGS. 7–11 show typical examples of various stirring patterns in which the attached posture of the divided stirrer units 4*a* and 4*b* are changed.

Figure 7:
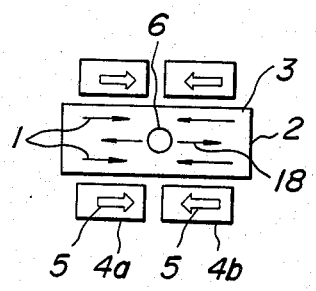
FIGS. 7–11 are schematic views illustrating various stirring patterns according to the present invention.

FIG. 7 is an embodiment in which the stirring flow 1 is produced in a direction opposite to the flow 18 discharged from the immersion nozzle 6, and this embodiment can contribute to the reduction in contamination of inclusions at a deep position, which is likely to happen in a high speed casting.

Figure 8:
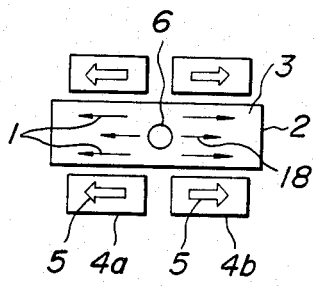

In FIG. 8, a stirring flow is produced along the discharged flow, thereby enchancing an effect of cleaning off the bubbles and the inclusion from the solidification structure which may come into problems in casting at a relatively low speed.

Figure 9:
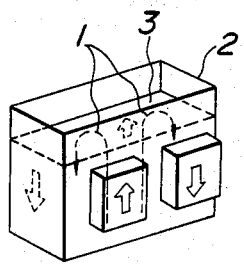
Figure 10:
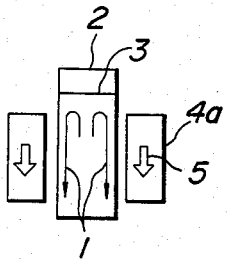
Figure 11:
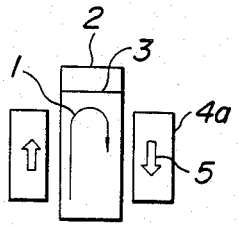

FIG. 9 is an embodiment in which stirring is done in an asymmetrically vertical fashion in the width direction of the mold to homogenously perform mixing in the mold, and FIG. 10 is an embodiment in which the reverse rimming flow is formed, and FIG. 11 is an embodiment in which the ascending and descending flows are produced along the forward and rearward long sides of the mold.

The selective switching of the electromagnetic stirring thrust in these stirring systems including the electrical operation of the wire connection can be easily done.

By dividing the stirrer as mentioned above, the stirring patterns of the molten steel can be increased to a large extent, and such a stirring pattern as to comply with the kind of the steel and the casting conditions over wider ranges can be selected.

EFFECTS OF THE INVENTION

Since stirring is switched between the horizontal direction and the vertical direction by adjusting the orientation of the installation of the divided stirrer unit, the stirring flow advantageous for the kind of the steel and the casting conditions can be selected for the continuous casting apparatus in which various kinds of the steels are to be treated. Thus, the effect of improving the quality of the cast slab is large.

We claim:

1. A method of electromagnetically stirring a molten steel in a continuously casting mold for producing a slab by using a linear motor-type stirrer arranged long sides of the continuously casting mold, which method comprises installing a plurality of rotatable units of said linear motor-type stirrer in parallel along the long sides of the mold, each unit having a square or an approximately square shape when viewed from the long side of the mold, selecting the orientation of the electromagnetically stirring thrust between the horizontal and vertical directions or between the normal and reverse directions thereof, depending upon the kind of steel intended and casting conditions by changing the installation posture or the current flowing direction of the stirrer units.

2. A method according to claim 1, wherein the flow of the molten steel in the horizontal direction or in the vertical direction is changed to be in the opposite direction thereto by making electrical operation.

3. A method according to claim 1, wherein the attaching orientation of the stirrer unit is changed by 90° to change the molten steel flow in the horizontal or vertical direction by 90°, whereby the flow is switched to the vertical flow or the horizontal flow.

4. An electromagnetically stirring type continuously casting apparatus, for producing a slab, which comprises a continuously casting mold, a linear-type stirrer arranged along long sides of the continuously casting mold, and comprising a plurality of rotatable stirrer units each having a square or approximately square shape as viewed from the long side of the mold and being installed in parallel along the long sides of the mold and adapted to change the stirring direction of the molten steel in the mold, whereby the orientation of the electromagnetically stirring thrust is selected between the horizontal and vertical directions thereof, or between the normal and reverse directions, depending upon the kind of steel intended and casting conditions, through changing the installation posture or the current flowing direction of the stirrer units.

5. An electromagnetically stirring type continuously casting apparatus as claimed in claim 4, comprising means for changing the flow of molten steel in the horizontal direction or in the vertical direction to an opposite direction in response to electromagnetic force.

6. An electromagnetically stirring type continuously casting apparatus as claimed in claim 4, comprising means for changing by 90° the attaching orientation of the stirrer units, so as to change a molten steel flow in the horizontal or vertical direction by 90°.

* * * * *